US006966546B2

(12) United States Patent
Winter et al.

(10) Patent No.: US 6,966,546 B2
(45) Date of Patent: Nov. 22, 2005

(54) LOWER BLOCK FOR A CABLE ACTUATOR

(75) Inventors: Klaus-Jürgen Winter, Wetter (DE); Karl Zacharias, Schwerte (DE)

(73) Assignee: Domag Cranes & Components GmbH, (DE)

( * ) Notice: Subject to any disclaimer, the term of this patent is extended or adjusted under 35 U.S.C. 154(b) by 0 days.

(21) Appl. No.: 10/796,621

(22) Filed: Mar. 9, 2004

(65) Prior Publication Data

US 2004/0183061 A1 Sep. 23, 2004

(30) Foreign Application Priority Data

Mar. 13, 2003 (DE) ..... 103 11 424

(51) Int. Cl.[7] ..... B66D 3/06
(52) U.S. Cl. ..... 254/402; 254/403; 294/82.1
(58) Field of Search ..... 254/390, 393, 254/404–406; 294/82.1, 82.11, 82.12, 85.15

(56) References Cited

U.S. PATENT DOCUMENTS

| | | | | |
|---|---|---|---|---|
| 1,436,725 A | | 11/1922 | Robertson et al. | |
| 1,523,733 A | | 7/1925 | Trout | |
| 1,671,435 A | | 5/1928 | McKissick | |
| 2,502,570 A | * | 4/1950 | Johnson | 254/402 |
| 2,650,403 A | * | 9/1953 | Taylor, Jr. et al. | 294/82.2 |
| 5,851,039 A | * | 12/1998 | Fanger et al. | 294/82.1 |
| 6,386,516 B1 | | 5/2002 | Lenders | 254/393 |

FOREIGN PATENT DOCUMENTS

| | | |
|---|---|---|
| DE | 815592 C | 10/1951 |
| DE | 3405759 C2 | 10/1986 |
| DE | 19602931 A1 | 7/1997 |
| DE | 19602931 C2 | 4/2001 |

OTHER PUBLICATIONS

Search Report from corresponding European Application No. EP 04 00 4898, dated May 18, 2004.

* cited by examiner

*Primary Examiner*—Emmanuel M Marcelo
(74) *Attorney, Agent, or Firm*—Van Dyke, Gardner, Linn & Burkhart, LLP

(57) ABSTRACT

The invention concerns a cable block, especially a lower block for cable controls, with at least one cable roller enclosed by a shrouding cover with entry and exit openings for a carrying cable, wherein a cover element is inserted in the entry and exit opening, having an opening for the carrying cable. The opening in the cover element is smaller than the entry and exit opening in the shrouding cover. In order to create a cable block, especially for a cable actuator, with improved protection against accidents, it is proposed that the entry and exit opening be slot-like and the cover element can be shifted in the entry and exit opening.

21 Claims, 6 Drawing Sheets

LOWER BLOCK FOR A CABLE ACTUATOR

BACKGROUND OF THE INVENTION

The invention concerns a cable block, especially a lower block for a cable actuator, with at least one cable roller or sheave that is enclosed in a shrouding cover, or housing, with entry and exit openings for a carrying cable.

From German Patent DE 196 02 931 C2, there is known a lower block for a cable actuator. The lower block essentially consists of a central connection element, which combines in itself both the function of an axle for cable rollers mounted thereon at both ends and able to turn, and the function of a receiving element for a loading hook. The loading hook is mounted from below in the connection element, able to turn about a vertical axle. At the opposite ends of the connection element, the two cable rollers are mounted coaxially to each other and able to rotate, and the carrying cables connected to the cable control are led around them. The cable rollers are provided with shrouding covers, or housings, as protection against accidents. The shrouding covers are supposed to prevent the operator's fingers or hands from being drawn in and clamped between cable and cable roller. In the already described lower block, the shrouding covers have an approximately square outer shape and are divided lengthwise. The lengthwise division is such as to produce a lid-type outer cover piece which is placed over the cable roller sideways on the outside until it comes to bear against an inner cover piece and is secured there. The line of separation of the two halves of the cover is roughly in the middle of the groove of the cable roller. The inner cover piece is ring-shaped and fashioned with a peripheral margin, against which the outer cover piece comes to bear, and it is an integral part of the connection element. Each of the shrouding covers is provided with two entry and exit openings, so that the carrying cable led around the roller can enter into the shrouding cover and again exit from it. The cable openings have a width that is roughly the width of the groove of the cable roller and thus corresponds to around three times the diameter of the carrying cable. The length of the cable opening is approximately 90° in terms of the circumference of the cable roller or the shrouding cover, leaving a separation web between the two entry and exit openings in the upper region of the shrouding cover. Assuming that the zero point of the angular system of coordinates is at the top in the middle of the shrouding cover, the first cable opening starts at about 15° and runs until 105° and the second cable opening extends from 255° to 345°. The cable openings are of such length because the angle subtended between the two strands of the carrying cables can vary between around 0° and 30°, depending on the configuration of the cable controls and the distance between the cable controls and the lower block. The point of departure of the carrying cable from the cable roller will vary accordingly in the region of the entry and exit openings. Since the diameter of the cable is only a fraction of the length of the entry and exit opening, it can further happen that the operator's hand or fingers will be drawn in by the carrying cable into the remaining space of the entry and exit opening.

SUMMARY OF THE INVENTION

The present invention is intended to create a lower block, especially for cable controls, with improved accident protection.

This problem is solved according to the invention by a lower block, especially for cable controls, with the features of claim 1. The subsidiary claims 2 through 9 indicate advantageous configurations of the lower block.

According to the invention, in a lower block, especially for cable controls, with at least one cable roller, which is enclosed by a shrouding cover with entry and exit openings for a carrying cable, an improved safety against accidents during handling by the operator is achieved in that a cover element is inserted in the entry and exit openings, having an opening for the carrying cable that is smaller than the entry and exit opening in the shrouding cover. The cover element with its relatively small opening thus successively prevents the operator's hand or finger from being drawn in by the carrying cable into the opening of the shrouding cover. Advantageously, the opening has a rectangular cross section, whose width and length stand in a ratio of 2:1 to 3:1 to the diameter of the carrying cable. Furthermore, the cover element advantageously prevents the carrying cable entering into and running out from the shrouding cover from grazing the edge of the entry and exit openings of the shrouding cover and thus getting worn. The cable roller is also better protected against penetration of dust, grime and moisture.

An especially long durability of the cover element is achieved in that the cover element can be shifted in the entry and exit opening and yet still cover the entry and exit opening, which is slot-like. Correspondingly, the cover element can be shifted in the circumferential direction of the cable roller in the entry and exit opening.

The cover element covering the entry and exit opening from the outside is secured especially easily to the shrouding cover, in that it grips the edges of the entry and exit opening inwardly. In a preferred design configuration, the cover element essentially consists of a base strip, a web strip, and a holding strip, which have an H-shaped cross section, and the holding strip lies with its guide surface against the inner surface of the shrouding cover in the region of the entry and exit opening.

In order to also allow cable deflections transverse to the roller and thereby protect the cover element, the opening deviates from circular shape and is enlarged transversely to the circumferential direction of the cable roller.

In a preferred configuration, the opening is fashioned as a channel, which extends from the side facing the cable roller to the side away from the cable roller and enlarges outwardly.

The cover element can be made especially easily and also wear-resistant as an injection molded plastic piece.

It has proven to be especially advantageous in design for the cover elements to be identical for the two entry and exit openings of the shrouding cover.

These and other objects, advantages and features of this invention will become apparent upon review of the following specification in conjunction with the drawings.

BRIEF DESCRIPTION OF THE DRAWINGS

An exemplary embodiment of the invention is depicted in a drawing and shall be described more closely hereafter, in which.

DETAILED DESCRIPTION OF THE PREFERRED EMBODIMENT

Figure 1:
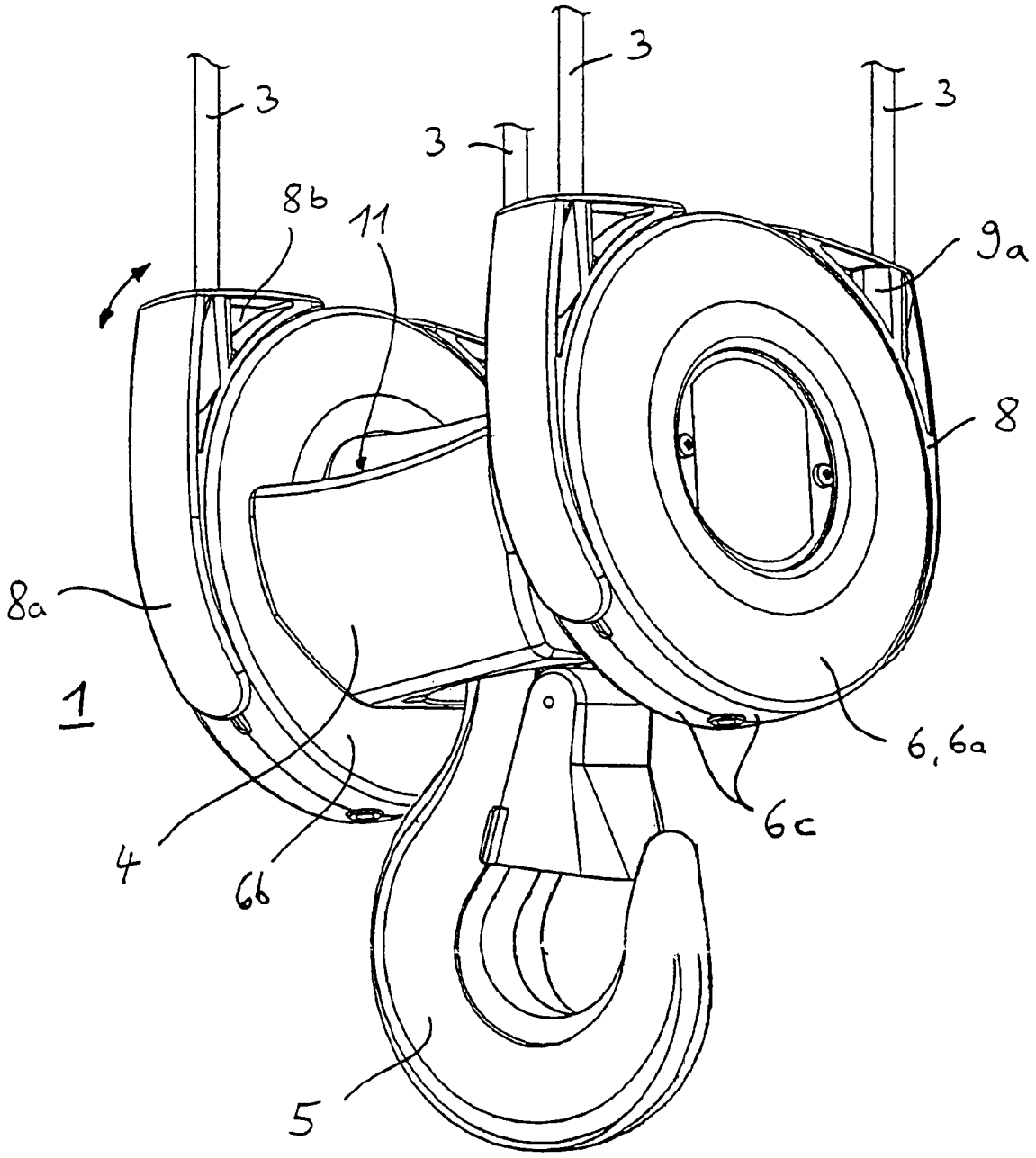
FIG. 1 is a perspective view of a lower block according to the invention with two cable rollers.
Figure 2:
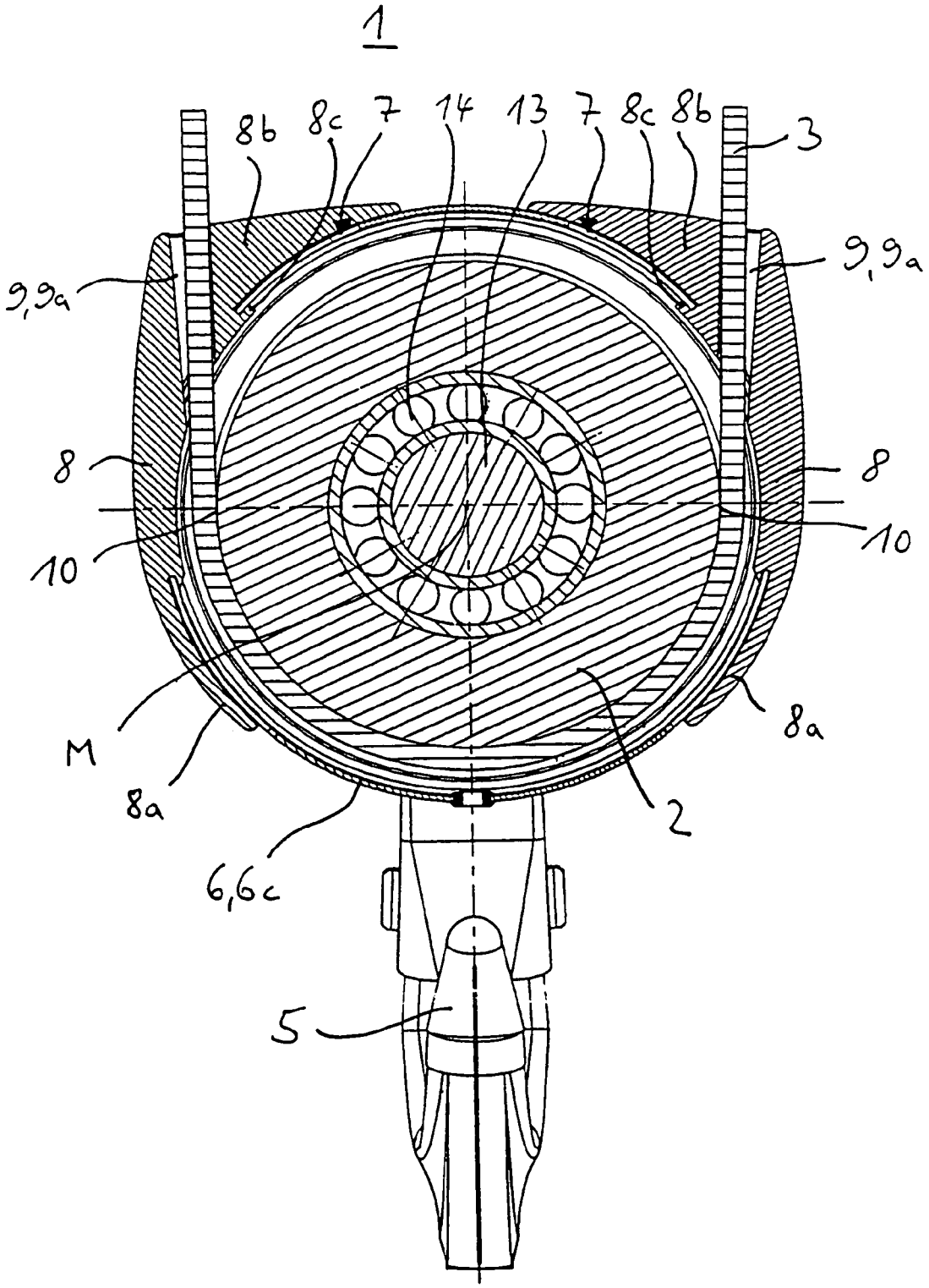
FIG. 2 is a side sectional view of the elevation of the lower block per FIG. 1 taken from the region of a shrouding cover of a cable roller with the cover elements in a first position.

Referring now to the drawings and the illustrative embodiments depicted therein, FIG. 1 shows a perspective view of a lower block 1 according to the invention, which is suspended from a cable actuator (not shown) by pairs of carrying cables 3, led around cable rollers 2 (see also FIG. 2). The lower block 1 consists essentially of a central connection element 4 with two cable rollers 2 mounted on it at the sides of the element and a load hook 5 suspended from the element at the bottom. The load hook 5 can turn about a vertical axis and is mounted in a recess of the connection element 4 by an axial bearing (not shown). The cable rollers 2, arranged coaxially to each other and separated from each other by the connection element 4, are each enclosed in circular shrouding covers 6, which are divided into an outer shrouding piece 6*a* and an inner shrouding piece 6*b* in the plane of the cable roller 2. In the illustrative embodiment, the two shrouding pieces 6*a*, 6*b* are substantially identical in configuration. The outer shrouding piece 6*a* and the inner shrouding piece 6*b* are each fashioned as flat annular disks with an outer circumferential rim 6*c*. The outer shrouding piece 6*a* and the inner shrouding piece 6*b* are thus in the shape of a disk or plate. In the installed condition, the outer shrouding piece 6*a* abuts with its rim 6*c* against the rim 6*c* of the inner shrouding piece 6*b*. The two shrouding pieces 6*a*, 6*b* thus delimit a flat cylindrical cavity to accommodate the cable roller 2. The angle-true assembly of the two shrouding pieces 6*a*, 6*b* is facilitated by a centering sleeve, which is inserted in corresponding recesses in the rims 6*c* of the shrouding pieces 6*a*, 6*b*.

In the shrouding covers 6 (also see FIG. 4), there are two entry and exit openings 7 arranged for the entering of the carrying cable 3 onto the cable roller 2 and its running off from the cable roller 2. These entry and exit openings 7 have a length L, looking in the circumferential direction of the cable roller 2 or the shrouding cover 6, which corresponds to a multiple of the diameter of the carrying cable 3 and thus they are slot shaped. The length L corresponds to a quarter of the circumference of the shrouding cover 6. This length L is necessary, because the angle between the strands of the carrying cables 3 varies during the operation of the cable control and thus the point of departure 10 (see FIG. 2) of the carrying cable 3 from the cable roller 2 will change. The present length L of the entry and exit openings 7 thus prevents the carrying cable 3 from rubbing against the rims of the entry and exit openings 7, which can cause damage. This is especially important, since the shrouding covers 6 are fashioned as sheet metal pieces.

The thus relatively large entry and exit openings 7 are each closed with a cover element 8, which has an opening 9 for leading the carrying cable 3 from the cable roller 2 or to the cable roller 2. The opening 9 for the carrying cable 3 is slightly larger than the diameter of the carrying cable 3 and has a rectangular cross section with rounded corners, whose width and length stand in a ratio of 2:1 to 3:1 to the diameter of the carrying cable 3. This has the effect of significantly reducing the risk of the operator's hands or fingers being pulled into the entry or exit openings 7 by the cable 3 running in. In order to provide for the previously described circumstance that the point 10 of running off of the cable 3 from the roller 2 varies during the operation of the lower block 1, the cover element 8 can be shifted back and forth between two end positions in the circumferential direction of the shrouding cover 6.

The cover element 8 consists essentially of a circular curved base strip 8*a*, corresponding to the rims 6*c* of the shrouding covers 6, which lies against the outer surface 6*d* of the rims 6*c* of the shrouding pieces 6*a*, 6*b*. Looking in the circumferential direction of the shrouding cover 6, the base strip 8*a* enlarges somewhat, starting in the middle, so as to produce a guiding region 8*b* for the cable 3 in the shape of an essentially right-angled triangle, whose correspondingly curved hypotenuse is formed by the base strip 8*a*.

It can also be seen from FIG. 1 that the opening 9 for the cable 3 in the cover element 8 is fashioned as a channel 9*a*, which extends from the base strip 8*a* to one of the two outer legs of the triangle of the guide region 8*b*. The lengthwise dimension of the channel 9*a* travels in the plane of the cable roller 2 at an angle of 90° to an imaginary line running through the point 10 of departure of the cable 3 from the cable roller 2 and the midpoint M of the cable roller 2.

Moreover, it will be noticed in FIG. 1 that the lower block 1 has an upwardly open recessed grip 11 in the area of the connection element 4, for easier handling by the operator, whose width corresponds to the distance between the two shrouding covers 6.

Figure 3:
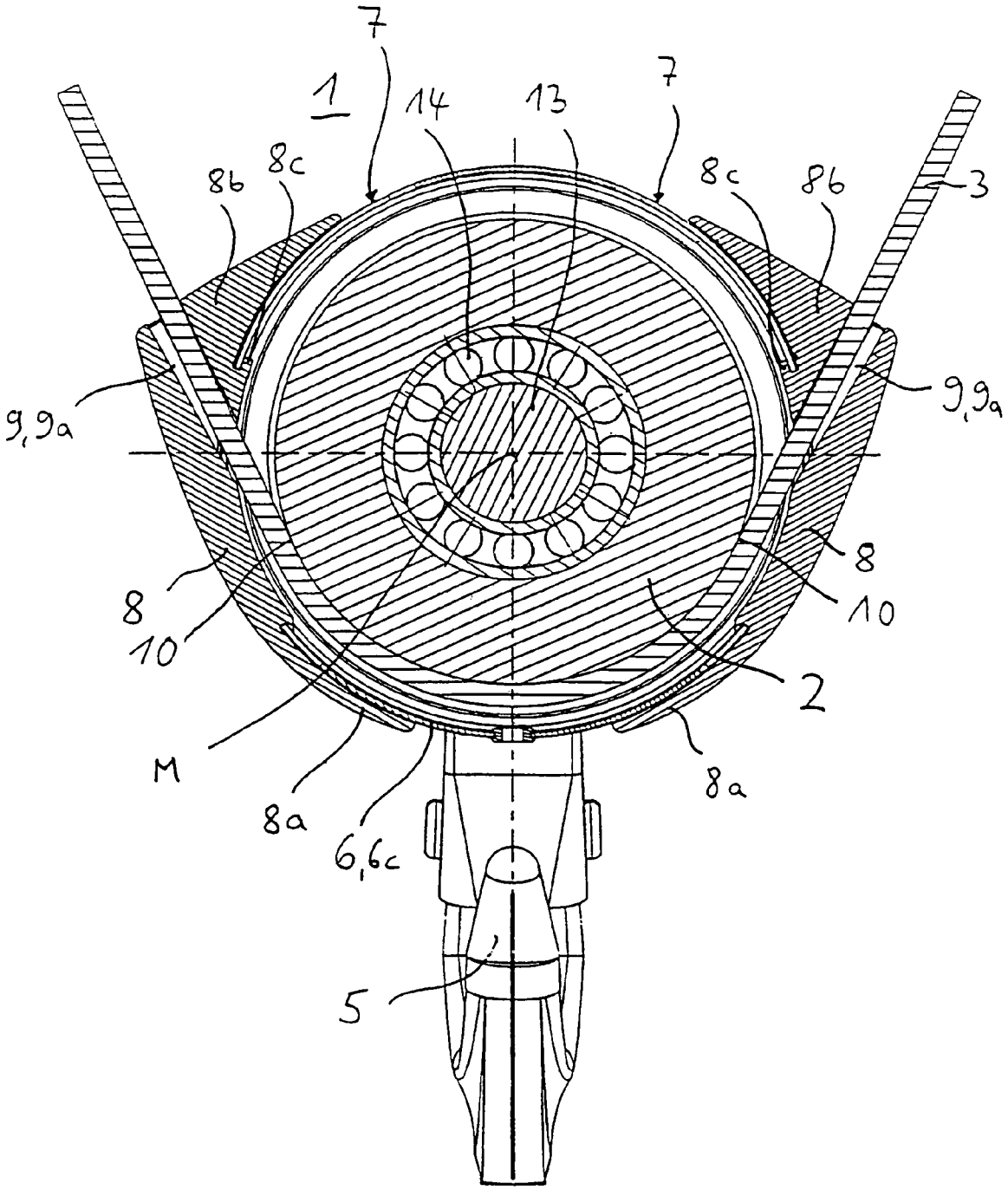
FIG. 3 is the same view as FIG. 2 with the cover elements in a second position.

FIGS. 2 and 3 each show a cross sectional view through one of the two cable rollers 2 with their adjoining shrouding cover 6 and the cover elements 8 in two different angle positions of the strands of the carrying cables 3 to each other and, thus, two different positions of shifting of the cover elements 8 in the cable opening 7.

In FIG. 2, the two cover elements S are each arranged in a so-called normal position in the entry and exit openings 7, in which the lower block 1 hangs perpendicular beneath the cable control and the two strands of the carrying cable 3 run parallel to each other. As can be seen, the channel 9*a* of the opening 9 runs nearly vertical and thus parallel to the carrying cables 3. Because of gravity, the inner wall of the channel 9*a* placed inwardly against the cable roller 2 will bear against the side of the cable 3 facing the opposite carrying cable 3, since the cover element 8 can shift with relatively little friction in the circumferential direction of the shrouding cover 6 in the entry and exit opening 7. The friction occurring between the carrying cable 3 and the channel 9*a* of the cover element is slight, since the cover element 8 is very light. Furthermore, being an injection molded plastic part, the cover element 8 is made from a material with good durability.

FIG. 3 shows the two cover elements 8 in a shifted position differing from the normal position represented in FIG. 2, in which the two strands of the carrying cables 3 subtend an angle of around 50° and thus the two cover elements 8 are located roughly in the region of their lowermost shifted position.

Figure 4:
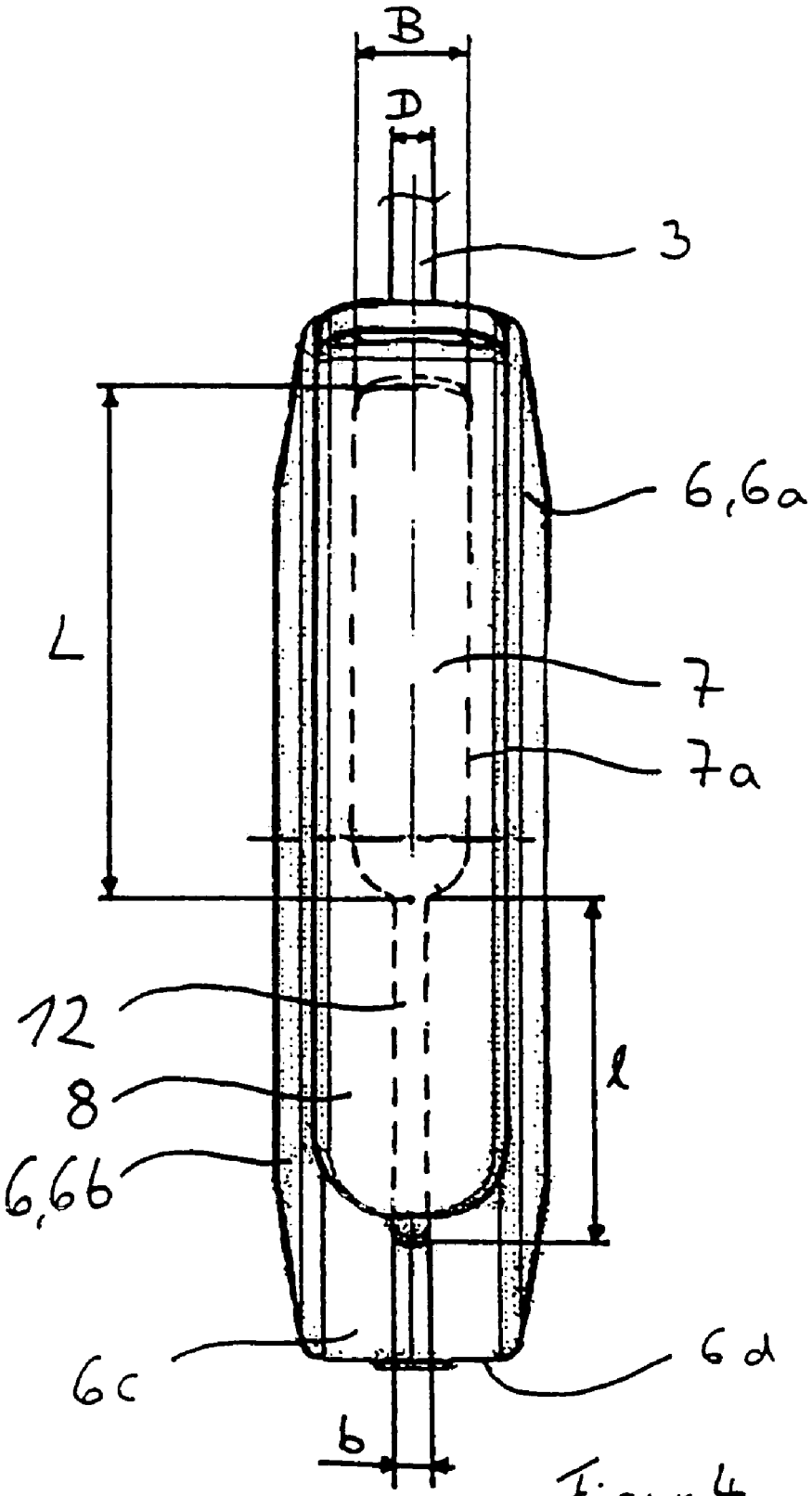
FIG. 4 is a front or rear end view of a shrouding cover.

In FIG. 4, a single shrouding cover 6 is represented in an orientation of a lower block 1 hanging vertically from the cable control. The viewing plane chosen is the front or rear side of the lower block 1 and perpendicular to the axis of rotation of the cable roller 2, so that one of the two cover elements 8 and the entry and exit opening 7 lying underneath are quite visible. The entry and exit opening 7 shown by the broken line in FIG. 4 has the shape of an oblong rectangle with rounded corners. The width B of the entry and exit opening 7 corresponds to roughly 2 to 3 times the diameter D of the carrying cable 3 and the length of the entry and exit opening 7 corresponds to around 10 to 15 times the diameter D of the cable 3. The cover element 8 is shown in its normal position.

FIG. 4 also shows that, in reference to the circumferential surface of the shrouding cover 6 and assuming that the angle of 0° is at the uppermost point of the shrouding cover 6, the first entry and exit opening 7 starts at around 15° and runs till 105°, the second entry and exit opening 7 starts in the region of 255° at the opposite side and ends at 345°. In addition, a slot 12 adjoins the lower rounded end of each entry and exit opening 7 in the middle, running in the circumferential direction of the shrouding cover 6 and being an extension of the entry and exit opening 7. This slot 12 ends in the region of 140° or 220°, respectively, and has a width b of around 7 mm. The cover element 8 is of such dimension in terms of its length that, in its extreme upwardly shifted position, the lower end of the entry and exit openings 7 is still covered. The slot 12 accommodates the web strip 8*d* of the cover element 8.

Figure 5:
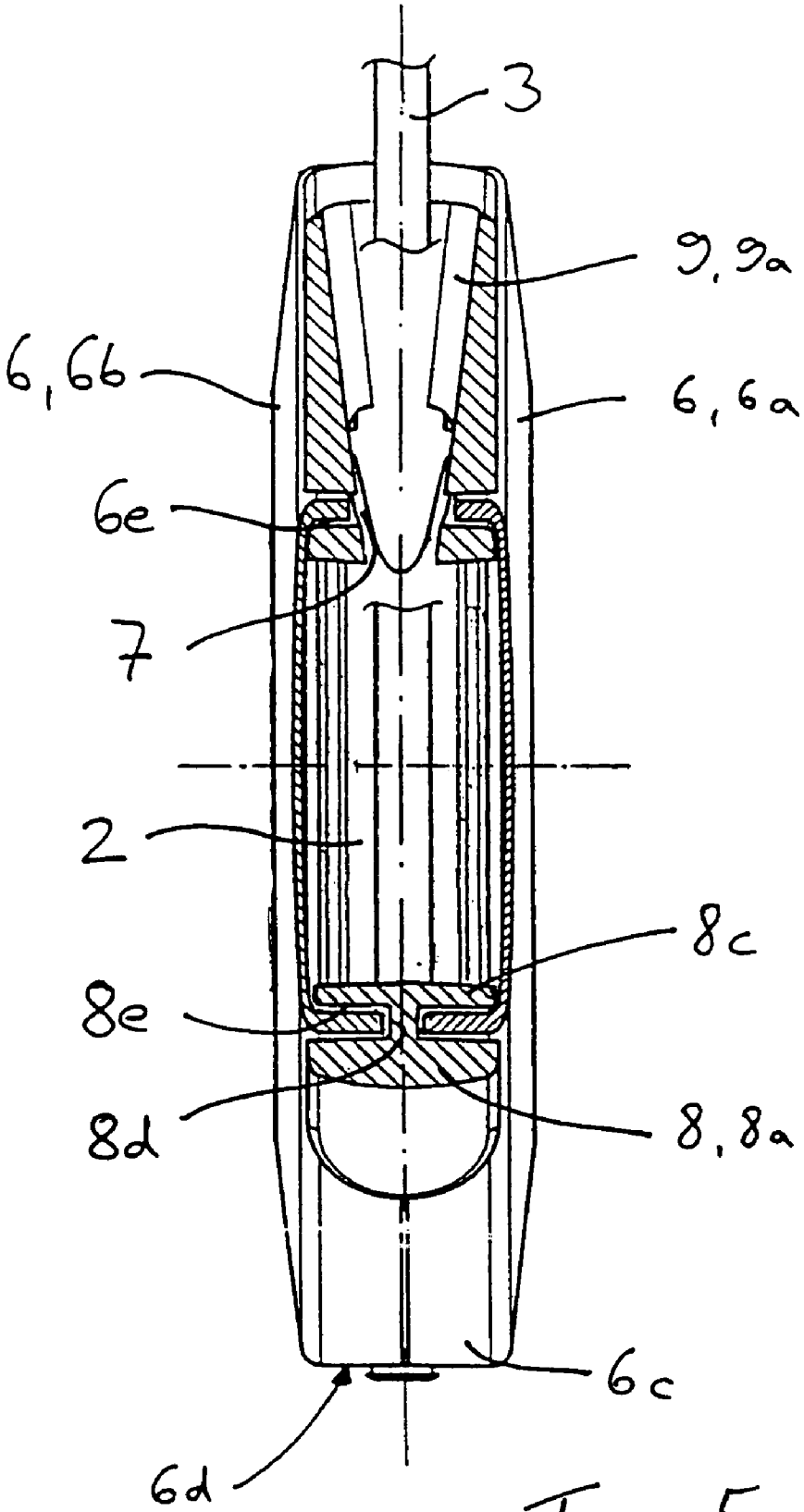
FIG. 5 is the same view as FIG. 4, partly in profile.

FIG. 5 shows a view per FIG. 4, but in a perpendicular sectional view, so that the cover element 8 is cut in the region of its channel 9*a*. In regard to the channel 9*a*, one notices that this expands upwardly, starting at the cable roller 2, transversely to the circumferential direction of the shrouding cover 6. Thus, the carrying cable 3 can also be deflected to the side, without there being too much rubbing between the carrying cable 3 and the inner wall of the channel 9*a*. As can be seen from FIGS. 2 and 3, the channel 9*a* on the other hand expands little in the circumferential direction, because here a deflection of the cable will be compensated by the shifting of the cover element 8 in the entry and exit opening 7.

Furthermore, FIG. 5 shows that the cover element 8 covers the rims of the entry and exit opening 7 on the outside by its base strip 8*a* and grasps them inwardly with a holding strip 8*c* and thus is fastened to them and able to shift in the circumferential direction of the shrouding cover 6. Thus, the holding strip 8*c* bears with its guide surface 8*e*, facing the rim 6*c*, against the inner surface 6*e* of the rim 6*c*. For this, the holding strip 8*c* is fastened by a central web strip 8*d* to the bottom side of the base strip 8*a*, so that the cover element 8 has an H-shaped cross section in this region. In the region of the opening 9, the web strip 8*d* is divided and enlarged accordingly. From FIG. 2 one notices that the holding strip 8*c* extends over a region of around 60°.

Figure 6:
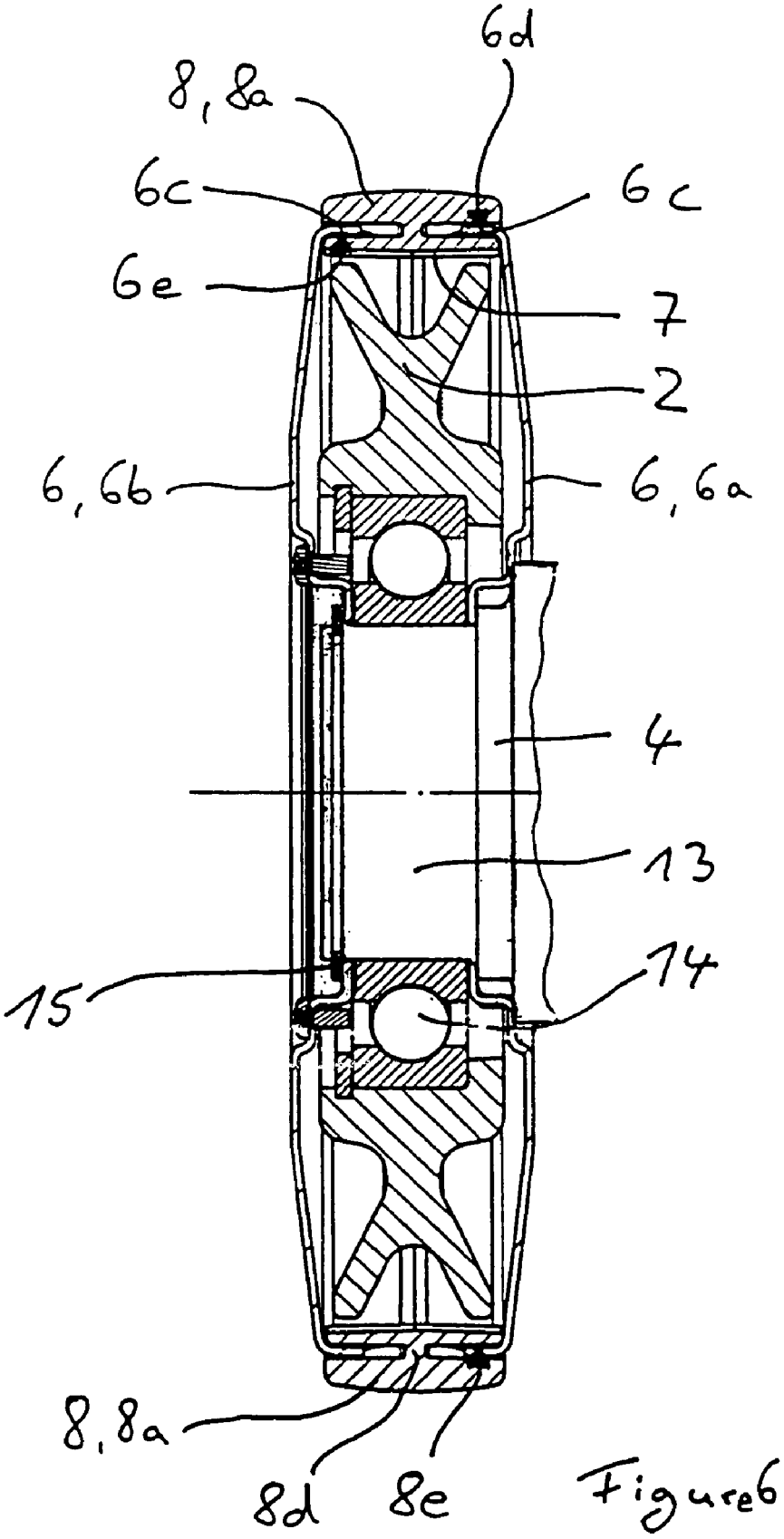
FIG. 6 is a sectional view of the cable roller and shrouding cover of FIG. 4.

FIG. 6 shows an additional cross sectional view of FIG. 4, in which the cut is situated across the axle 13 of the cable roller 2. The axle 13 is part of the connection element 4. The cable roller 2 is mounted on the axle 13 by a bearing 14. The axle 13 also serves to support the circular inner and outer shrouding pieces 6*a*, 6*b*, which are fashioned as sheet metal parts. The inner shrouding piece 6*b*, which is the first one shoved onto the axle, bears against a shoulder of the connection element 4, bounding the axle 13, and is then followed by the bearing 14 and then the outer shrouding piece 6*a*, which is held on the axle 13 by a securing ring 15. Furthermore, the circular outer shrouding piece 6*a* is closed by a round circular cover 15 in the area of the axle 13.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A lower cable black for a cable actuator, comprising:

at least one cable roller enclosed by a shrouding cover with entry and exit openings for a carrying cable;

cover elements in said entry and exit openings, said cover elements having cover openings for the carrying cable, said cover openings in the cover elements being smaller than said entry and exit openings in the shrouding cover;

wherein said entry and exit openings are elongated openings and said cover elements can be shifted with respect to said entry and exit openings by said carrying cable during operation of the lower cable block.

2. The cable block of claim 1 wherein said cover elements can be shifted in the circumferential direction of said cable roller in said entry and exit openings.

3. The cable block of claim 2 wherein said cover elements cover said cable openings from the outside and grasps rims of the respective said cable openings inwardly.

4. The cable block of claim 3 wherein said cover elements have an H-shaped cross section comprising a base strip, a web strip and a holding strip wherein said holding strip hears with a guide surface against an inner surface of said shrouding cover in the region of said entry and exit openings.

5. The cable block of claim 4 wherein said cover openings for the carrying cable have an opening surface whose width and length stand in a ratio of 2:1 to 3:1 to the diameter of said carrying cable.

6. The cable block of claim 5 wherein said cover openings for the carrying cable deviate from a circular shape and are wider transverse to the circumferential direction of said cable roller.

7. The cable block of claim 6 wherein said cover openings for the carrying cable are fashioned as a channel that extends from the side facing said cable roller to a side facing away from said cable roller and expand outwardly.

8. The cable block of claim 7 wherein said cover elements are made as an injection molded plastic piece.

9. The cable block of claim 8 wherein said cover elements are substantially identical.

10. The cable block of claim 1 wherein said cover elements cover the cable openings from the outside and grasps the rims of the respective said cable openings inwardly.

11. The cable block of claim 10 wherein said cover openings for the carrying cable have an opening surface whose width and length stand in a ratio of 2:1 to 3:1 to the diameter of said carrying cable.

12. The cable block of claim 11 wherein said cover openings far the currying cable deviate from a circular shape and are wider transverse to the circumferential direction of said cable roller.

13. The cable block of claim 12 wherein said cover openings for the carrying cable are fashioned as a channel that extends from the side facing said cable roller to a side facing away from said cable roller and expand outwardly.

14. The cable block of claim 13 wherein said cover elements are made as an injection molded plastic piece.

15. The cable block of claim 14 wherein said cover elements are substantially identical.

16. The cable block of claim 1 wherein said cover openings for the carrying cable have an opening surface whose width and length stand in a ratio of 2:1 to 3:1 to the diameter of said carrying cable.

17. The cable block of claim 1 wherein said cover openings for the carrying cable deviate from a circular shape and are wider transverse to the circumferential direction of said cable roller.

18. The cable block of claim 1 wherein said cover openings for the carrying cable are fashioned as a channel that extend from the side facing said cable roller to a side facing away from said cable roller and expands outwardly.

19. The cable block of claim 1 wherein said cover elements are made as an injection molded plastic piece.

20. The cable block of claim 1 wherein said cover elements are substantially identical.

21. A lower cable block for a cable actuator, comprising:

at least one cable roller enclosed by a shrouding cover with entry and exit openings for a carrying cable;

cover elements in said entry and exit openings, said cover elements having cover opening for the carrying cable, said cover openings in the cover elements being smaller than said entry and exit opening in the shrouding cover;

wherein said entry and exit openings are elongated openings and said cover elements can be shifted with respect to said entry and exit openings, wherein said cover elements have an H-shaped cross section comprising a base strip, a web strip and a holding strip wherein said holding strip bears with a guide surface against an inner surface of said shrouding cover in the region of the entry and exit openings.

* * * * *

UNITED STATES PATENT AND TRADEMARK OFFICE

CERTIFICATE OF CORRECTION

PATENT NO. : 6,966,546 B2
APPLICATION NO. : 10/796621
DATED : November 22, 2005
INVENTOR(S) : Klaus-Jürgen Winter and Karl Zacharias It is certified that error appears in the above-identified patent and that said Letters Patent is hereby corrected as shown below:

Column 4:
Line 32, "S" should be --8--.

Column 6:
Line 3, Claim 1, "black" should be --block--.
Line 23, Claim 4, "hears" should be --bears--.
Line 51, Claim 12, "far" should be --for--.
Line 51, Claim 12, "currying" should be --carrying--.

Column 8:
Line 2, Claim 21, "opening" should be --openings--.
Line 4, Claim 21, "opening" should be --openings--.

Signed and Sealed this

Twentieth Day of February, 2007

JON W. DUDAS
*Director of the United States Patent and Trademark Office*